US005253376A

United States Patent [19]

Fait

[11] Patent Number: 5,253,376

[45] Date of Patent: Oct. 19, 1993

[54] ILLUMINATED SANITARY APPLIANCE

[75] Inventor: Claudio Fait, Milan, Italy

[73] Assignee: Ideal Standard S.p.A., Milan, Italy

[21] Appl. No.: 950,669

[22] Filed: Sep. 25, 1992

[30] Foreign Application Priority Data

Sep. 26, 1991 [IT] Italy ..... RE91U00069

[51] Int. Cl.[5] ..... E03C 1/322; E03C 1/326

[52] U.S. Cl. ..... 4/643; 4/619; 4/661; 362/133

[58] Field of Search ..... 4/619, 638, 643, 654, 4/661; 362/101, 133

[56] References Cited

U.S. PATENT DOCUMENTS

| | | | |
|---|---|---|---|
| 1,659,851 | 2/1928 | Brewington | 4/643 |
| 2,000,537 | 5/1935 | Ransom | 362/133 |
| 2,594,792 | 4/1952 | Motter | 362/133 |
| 3,487,478 | 1/1970 | Harris | 4/619 |
| 4,646,370 | 3/1987 | Risberg et al. | 4/661 |
| 4,700,048 | 10/1987 | Levy | 219/214 |
| 4,736,471 | 4/1988 | Johnson | 4/661 X |

FOREIGN PATENT DOCUMENTS

| | | |
|---|---|---|
| 3229451 | 2/1984 | Fed. Rep. of Germany . |
| 8800868 | 6/1988 | Fed. Rep. of Germany . |
| 3907607 | 9/1990 | Fed. Rep. of Germany . |

*Primary Examiner*—Henry J. Recla
*Assistant Examiner*—Robert M. Fetsuga

[57] ABSTRACT

The support element (10) comprises a concave portion (11) having its concavity facing the vertical wall (3) and arranged define at the front, and at least in part laterally, a shell closed at its rear by the vertical wall (3) to determine a chamber (12), and an electric lamp (20) installed within the chamber (12), the chamber (12) comprising one or more lateral apertures (13) and/or lower apertures (14) which enable the light produced by the electric lamp (20) to escape from the chamber (12).

5 Claims, 4 Drawing Sheets

ILLUMINATED SANITARY APPLIANCE

BACKGROUND OF THE INVENTION

1. Field of the Invention

This invention relates to a support element for sanitary appliances of the type comprising a bowl suitable for the purpose for which the appliance is intended (for example, to enable the hands and upper parts of the body to be washed in the case of a wash-basin). The support element is positioned below the bowl and arranged to support the appliance which is intended to be applied to a wall.

2. Description of Background Art

The invention relates in particular to wash-basins; it can however be applied to bidets, urinals or other appliances.

The object of the invention is to improve known sanitary appliances to make them more comfortable to use during the night, while at the same time enhancing their appearance.

The concept on which the invention is based is to arrange an electric lamp within the support element of these appliances and to use as the light diffuser the concavity which said elements typically possess, and which faces the wall; this concavity is closed upperly for example by the bowl which rests on the support element, and at its rear by the wall. The light produced by the electric lamp diffuses within this chamber and escapes through one or more lateral and/or lower slots to diffuse indirectly onto the vertical wall and/or onto the floor, to hence diffuse into the surrounding environment. In this manner relatively soft diffused lighting is obtained and can be advantageously used constantly during the night as "courtesy lighting", ie to provide constant light which is sufficient to define the outlines of the appliance and of possible other nearby appliances, while at the same time being of low intensity so as not to diffuse large quantities of light into nearby rooms. This "courtesy lighting" can hence be advantageously used to facilitate the movement of persons wishing to use the illuminated sanitary appliance or other appliances present in the same room, without it being necessary to turn on the main room lighting and hence without disturbing persons sleeping in nearby rooms.

This lighting also enhances the appearance of the appliances to which it is applied.

BRIEF DESCRIPTION OF THE DRAWINGS

The invention is described in detail hereinafter with reference to the accompanying drawings which illustrate two different embodiments thereof, both relating to a wash-basin.

DETAILED DESCRIPTION OF THE PREFERRED EMBODIMENTS

Figure 1:
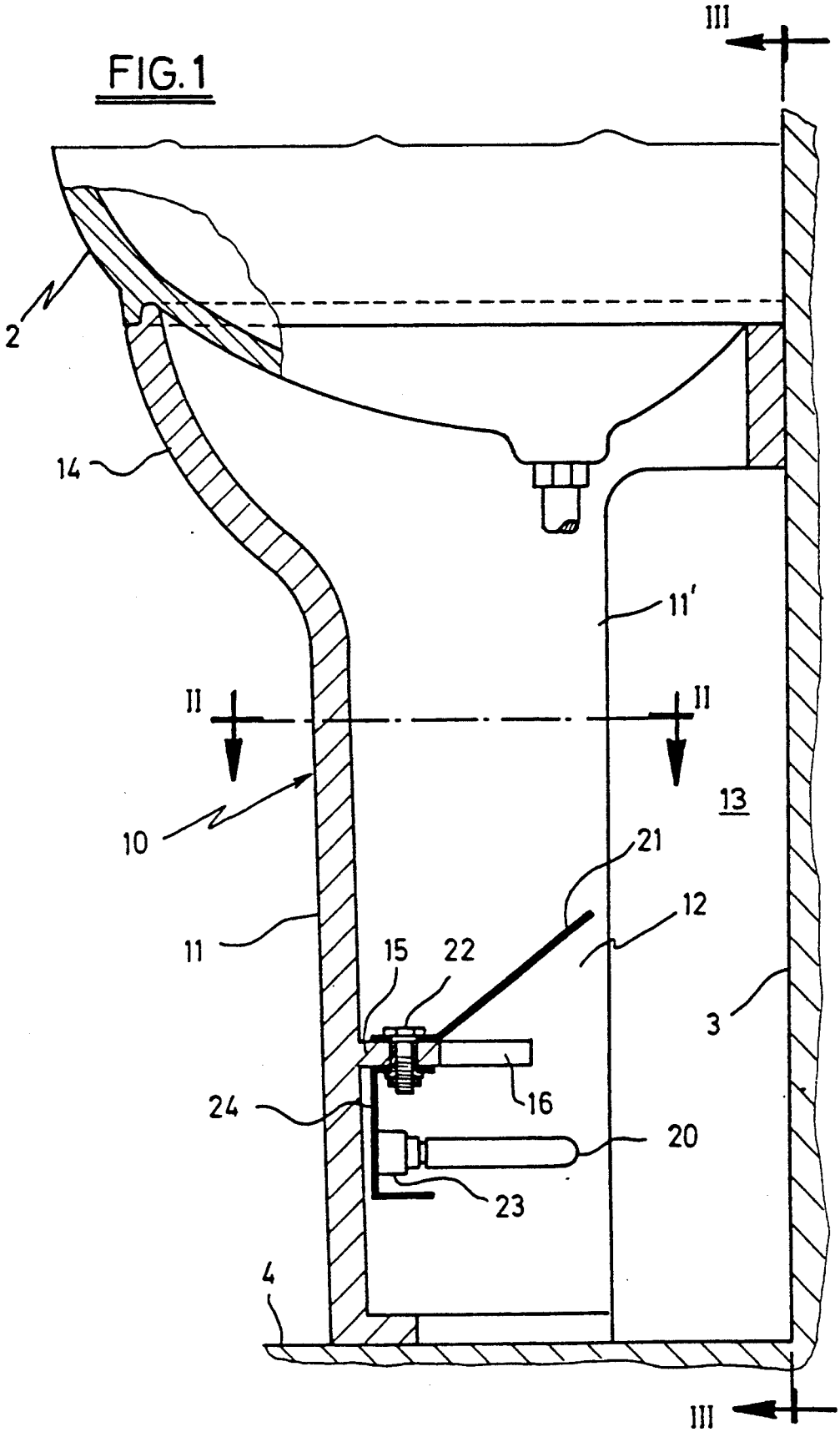
FIG. 1 is a section through a sanitary appliance according to the invention, taken on the vertical plane of symmetry.

In the accompanying figures, a bowl 2 is provided (shown only partly in the figures and not further described) of any known type, suitable for the purpose for which the appliance is intended: in particular the bowl 2 is such as to enable the hands and other parts of the human body to be washed if the appliance is a wash-basin, as illustrated in the figures.

A support element 10 is provided below the bowl 2 to support the bowl.

A vertical wall 3 is provided to which the appliance is to be applied, by fixing to the wall bowl 2, or only the support element 10, or both.

The support element 10 comprises at least one concave portion 11 with its concavity facing the wall 3 and arranged to define at its front, and at least in part laterally, a chamber 12 which is closed at its rear by the wall 3.

Within the chamber 12 there is installed an electric lamp 20, preferably of the fluorescent type powered by low voltage current.

In addition, the chamber 12 defines with the wall 3 two lateral apertures 13 which enable the light produced by the lamp 20 to escape from the chamber 12.

In the embodiments shown in the figures, a screen 21 is provided for the lamp 20, it being positioned above this latter and having in plan view an extension which is greater than the lamp 20 but somewhat smaller than the chamber 12.

Figure 3:
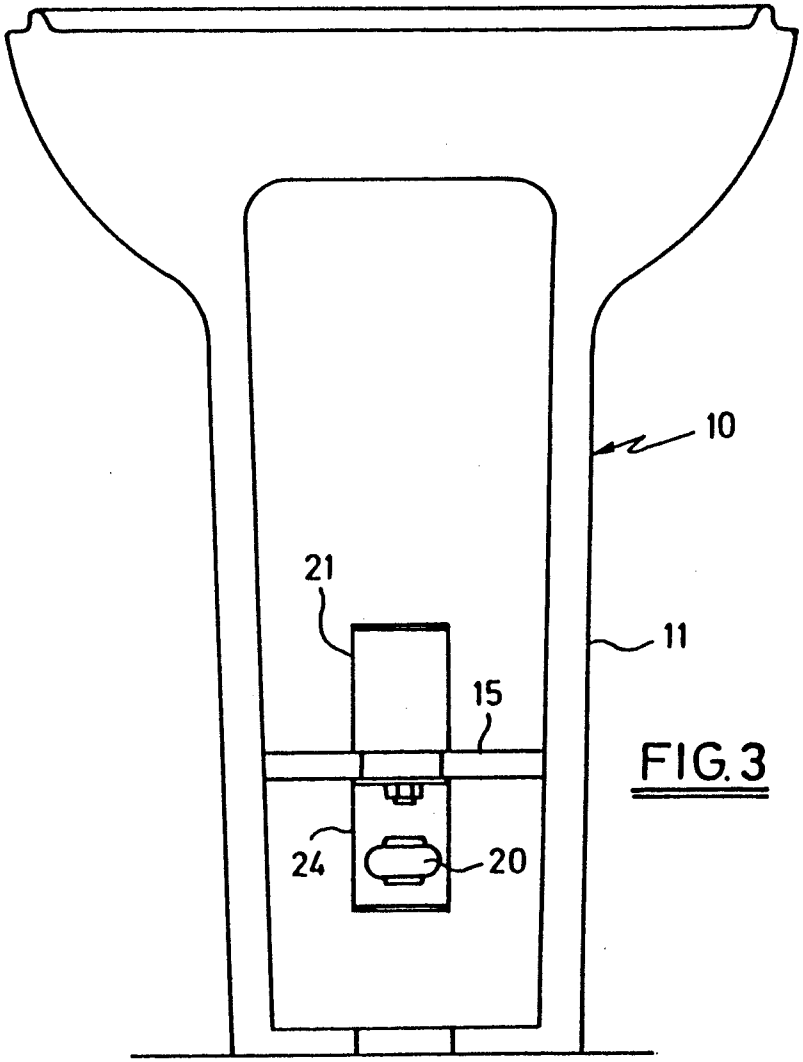
FIG. 3 is a section on the plane III—III of FIG. 1.
Figure 2:
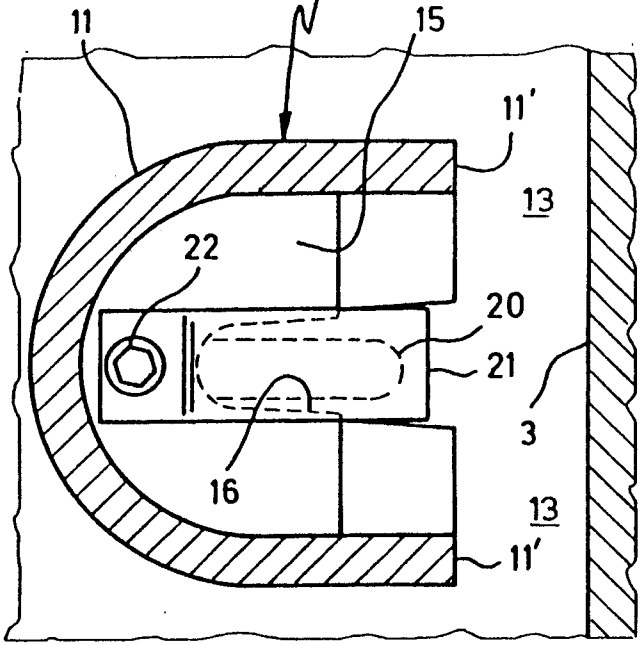
FIG. 2 is a section on the plane II—II of FIG. 1.

In the appliance shown in FIGS. 1-3, the support element 10 comprises a lower portion which rests on the floor 4. This lower portion defines said concave portion 11 and has a cross-section, taken on any horizontal plane, which is arched with its concavity facing the vertical wall 3. In addition, said lower portion is positioned spaced from the wall 3 so that between its vertical edges 11' and the wall 3 two vertically extending lateral apertures 13 are defined to enable the light produced by the lamp 20 to escape, said lamp 20 being positioned in the concavity defined by the lower portion 11.

Above the portion 11 there is an upper portion 14 also having its concavity facing the wall 3 and having a cross-section which widens upwards to define a sort of cup, on the upper edge of which there rests the bowl 2.

The chamber 12 is bounded at its front and in part laterally by the two concave portions 11 and 14, upperly by the bowl 2, at its rear by the wall 3 and lowerly by the floor 4.

Within the element 10 there is provided a rib 15 projecting horizontally from the inner surface of the lower portion 11. Said rib 15 extends, in plan view, in C form to define a horizontal aperture 16 located in a position substantially central within the horizontal cross-section through the lower portion 11 (see FIG. 2). The screen 21 is fixed by a bolt 22 to the central point of the rib 15 and is inclined upwards towards the wall 3 to extend above the aperture 16. The lamp 20 is positioned below and centrally to the aperture 16. A suitable lampholder 23 is supported with its axis horizontal by a bracket 24 fixed to the central point of the rib 15, below the screen 21. Suitable electric cables, not shown, power the lamp 20 with mains electricity.

The light produced by the lamp 20 diffuses into the chamber 12, and because of the presence of the screen 21 remains restricted almost exclusively to the region below the screen 21. This light is directed towards the wall 3 and is reflected by it. Part of the light reflected by the wall 3 leaves the chamber 12 through the apertures 13 and diffuses into the surrounding environment, in particular being reflected on the floor. Soft diffused courtesy lighting is therefore advantageously created within the room containing the appliance, as heretofore described.

Figure 4:
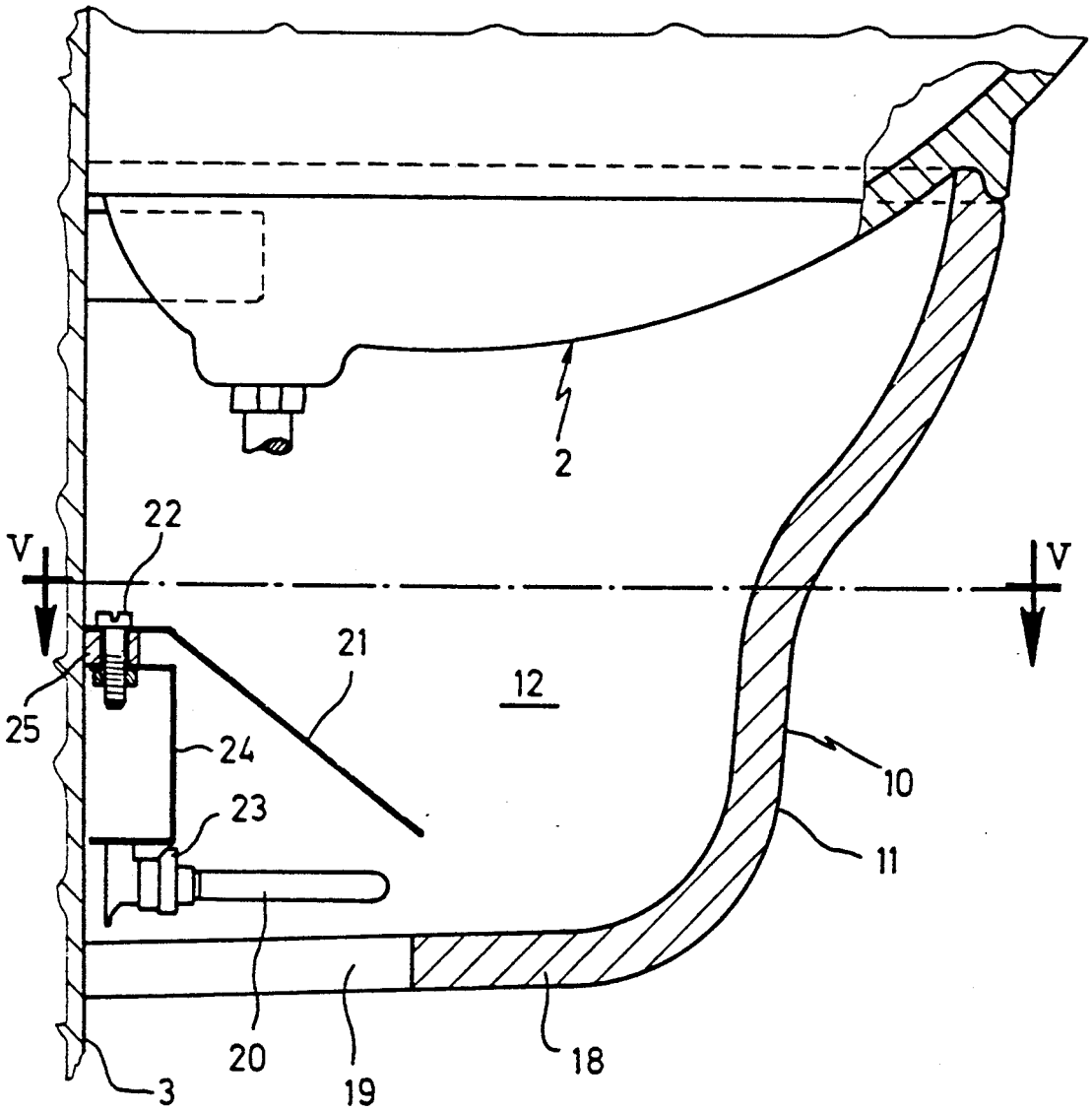
FIG. 4 is a section through a second embodiment of an appliance according to the invention, taken on the vertical plane of symmetry.
Figure 5:
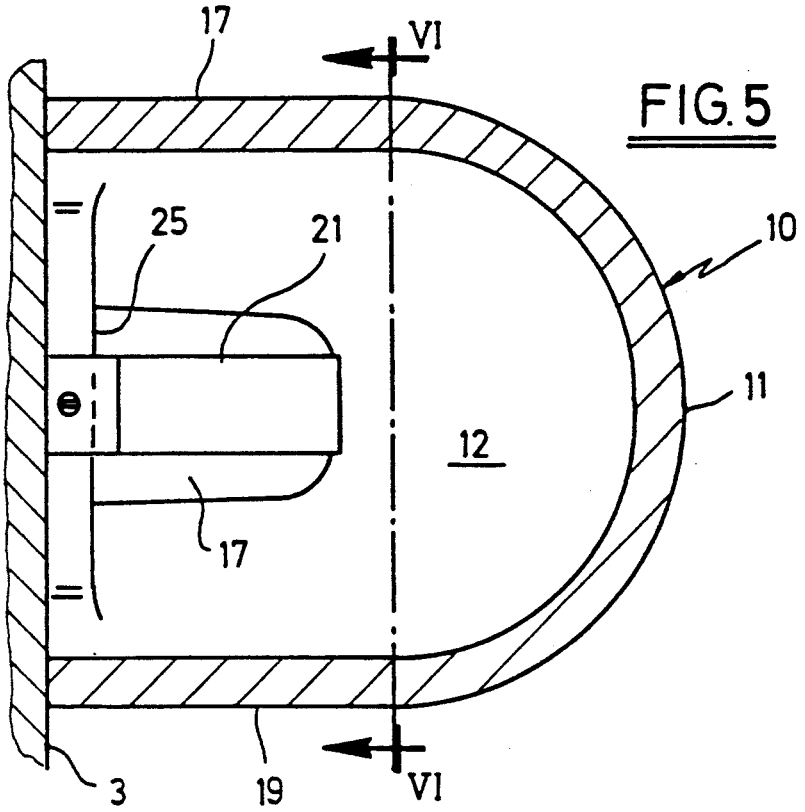
FIG. 5 is a section on the plane V—V of FIG. 4.
Figure 6:
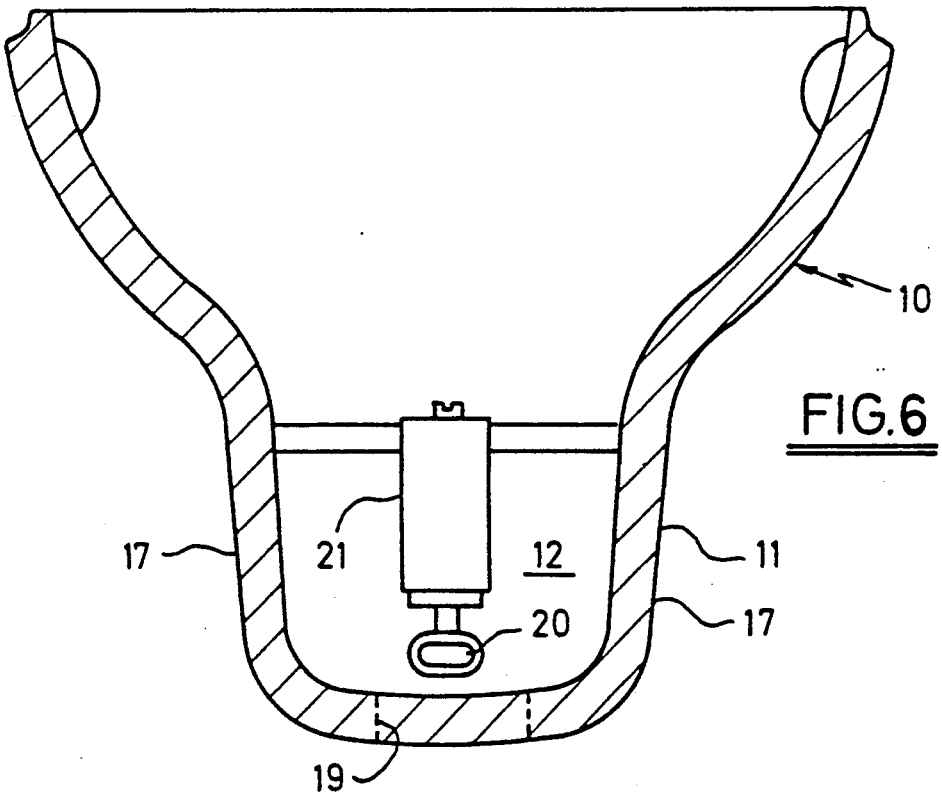
FIG. 6 is a section on the plane VI—VI of FIG. 5

In the appliance shown iii FIGS. 4–6 the support element 10 is directly fixed to the wall 3 at a distance from the floor 4. The chamber 12 is closed completely at its sides by the lateral faces 17 of the support element 10 and lowerly by the face 18. In the face 18 there are provided one or more apertures 19 for passage of the light.

The screen 21 is fixed by a bolt 22 to a small crosspiece 25 rigidly joined to the support element 10 and positioned adjacent to the wall 3. The screen 21 faces downwards and outwards. The lamp 20 is positioned above and centrally to the aperture 19. Again in this case, the lampholder 23 is supported by the bracket 24, which is fixed to a central point of the crosspiece 25.

Part of the light produced by the lamp 20 escapes radially through the aperture 19; a further part diffuses within the chamber 12, of which part is then reflected outside the chamber 12 through the aperture 19; finally, a further part of the light is reflected by the screen 21 directly to the outside through the aperture 19. The light which leaves through the aperture 19 is directed towards the floor 4 and towards the lower region of the wall 3, and is reflected by these to diffuse into the surrounding environment by reflection. Soft diffused courtesy lighting is therefore again advantageously created within the room containing the appliance, as heretofore described.

The screen 21 serves both as a screen for the light, and to protect the lamp 20 and lampholder 23 from any water droplets should these fall from the bowl 2.

I claim:

1. A support element for use with a sanitary appliance of the type comprising a bowl (2) mounted adjacent a vertical wall (3), and above a floor (4) said support element (10) comprising a shell having at least one concave portion (11) with its concavity positioned to face the wall (3) and the shell being arranged to define an enclosed chamber (12) when the shell is mounted to an undersurface of the bowl and against the wall (3), an electric lamp (20) being mounted to an interior surface of said shell within said chamber (12), said shell comprising at least one opening (13) therethrough which enables the light produced by the electric lamp (20) to escape from said chamber (12).

2. The support element according to claim 1, wherein a screen (21) is mounted above the lamp and extends in plan view to occlude the lamp (20) from view, said shell being sized so that said chamber (12) is closed at an upper end by the bowl (2).

3. The support element according to claim 2, wherein said support element comprises an internal rib (15) projecting horizontally from the inner surface of the shell, said rib (15) having an aperture (16) for mounting the screen (21), said screen (21) being positioned above said rib (15) and forming an angle thereto, said electric lamp (20) being positioned below the rib (15).

4. The support element according to claim 1, wherein the at least one concave portion comprises a lower portion (11) of the shell sized to extend to the floor (4) to define the chamber (12), wherein the shell comprises a second opening (13) therethrough to enable the light produced by the electric lamp (20) to escape, said openings (13) being positioned substantially in said lower portion (11).

5. The support element according to claim 1, wherein the at least one concave portion comprises a lower portion (11) of the shell sized to be spaced a distance from the floor (4), wherein said shell includes a lower wall (18) to define the chamber (12), said at least one opening (13) being provided in the lower wall (18).

* * * * *